US009193427B1

(12) United States Patent
Nuss

(10) Patent No.: US 9,193,427 B1
(45) Date of Patent: Nov. 24, 2015

(54) FLOATING VESSEL WITH APPENDAGES FOR REDUCED VIBRATION AND INCREASED THRUSTER CAPACITY

(71) Applicant: GULF COAST SHIPYARD GROUP, INC., Gulfport, MS (US)

(72) Inventor: William Philip Nuss, Gulfport, MS (US)

(73) Assignee: GULF COAST SHIPYARD GROUP, INC., Gulfport, MS (US)

( * ) Notice: Subject to any disclaimer, the term of this patent is extended or adjusted under 35 U.S.C. 154(b) by 0 days.

(21) Appl. No.: 14/681,039

(22) Filed: Apr. 7, 2015

(51) Int. Cl.

| | |
|---|---|
| ***B63H 11/103*** | (2006.01) |
| ***B63H 25/04*** | (2006.01) |
| ***B63H 21/30*** | (2006.01) |
| ***B63H 21/38*** | (2006.01) |
| ***B63B 17/00*** | (2006.01) |

(52) U.S. Cl.
CPC ..... *B63H 11/103* (2013.01); *B63B 17/0081* (2013.01); *B63H 21/302* (2013.01); *B63H 21/38* (2013.01); *B63H 25/04* (2013.01); *B63H 2025/045* (2013.01)

(58) Field of Classification Search
CPC ..... B63H 11/00; B63H 11/04; B63H 11/08; B63H 11/103; B63H 25/46; B63H 1/16
USPC ..... 440/1, 46, 47; 114/151
See application file for complete search history.

(56) References Cited

U.S. PATENT DOCUMENTS

| | | | | |
|---|---|---|---|---|
| 3,835,805 | A * | 9/1974 | Slade | 114/151 |
| 6,286,447 | B1 * | 9/2001 | Beauchamp et al. | 114/151 |
| 7,108,569 | B2 * | 9/2006 | Cornell | 440/47 |

* cited by examiner

*Primary Examiner* — Lars A Olson
(74) *Attorney, Agent, or Firm* — Buskop Law Group, PC; Wendy Buskop

(57) ABSTRACT

A floating vessel having a hull, at least one thruster tube, at least one water moving device and at least one power supply in the thruster tube. At least one appendage partially surrounds the thruster tube and encircles the thruster tube from 30 percent to 40. A plurality of supports secures the at least one appendage to the hull. At least one fairing plate is installed between a tangent of the appendage and the hull for following a circumference of the thruster tube and encircling the thruster tube from 30 percent to 40 percent, wherein the fairing plate is configured to transition water flow from the hull over the appendage and into the thruster tube to reduce water turbulent flow across an opening of the thruster tube.

17 Claims, 4 Drawing Sheets

FIGURE 4
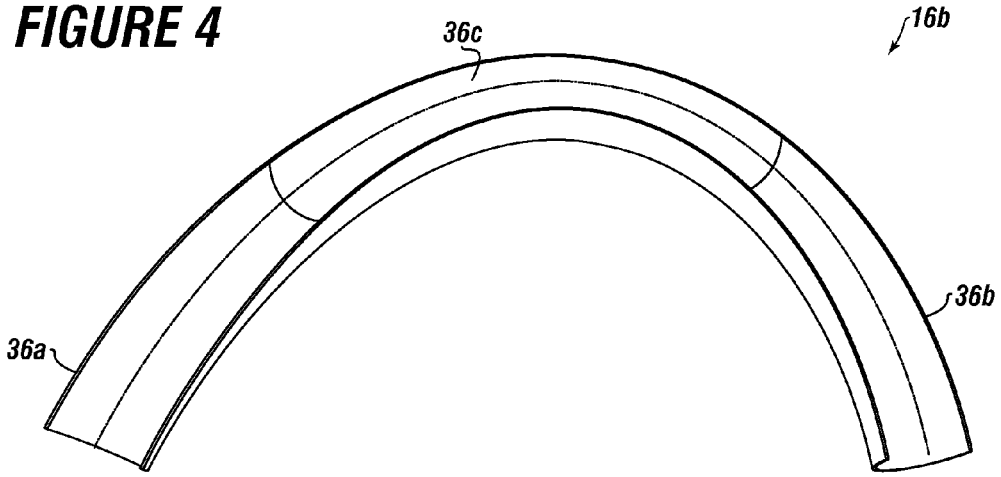
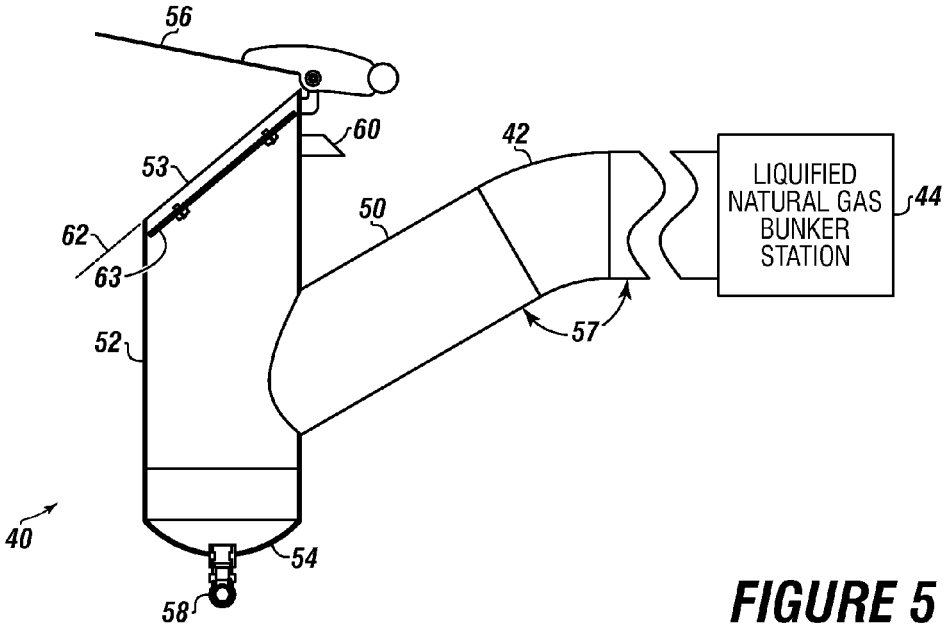
FIGURE 5

FLOATING VESSEL WITH APPENDAGES FOR REDUCED VIBRATION AND INCREASED THRUSTER CAPACITY

FIELD

The present embodiments generally relate to a floating vessel with improved bow and/or stern thrusters and a dual fuel version of the floating vessel with an improved gas line trap.

BACKGROUND

A need exists for a floating vessel with improved thrust capacity in bow and stern thrusters while simultaneously reducing vibration in the bow and stern thrusters.

A further need exists for a dual fuel floating vessel, such as a ship, with improved gas line traps.

The present embodiments meet these needs.

BRIEF DESCRIPTION OF THE DRAWINGS

The detailed description will be better understood in conjunction with the accompanying drawings as follows:

FIG. 4 depicts an elevation view of a segmented appendage presented as a half-pipe according to one or more embodiments.

FIG. 5 depicts a side view of a relief gas line vent trap usable in a dual fuel version of the floating vessel of FIG. 1A.

Figure 1A:
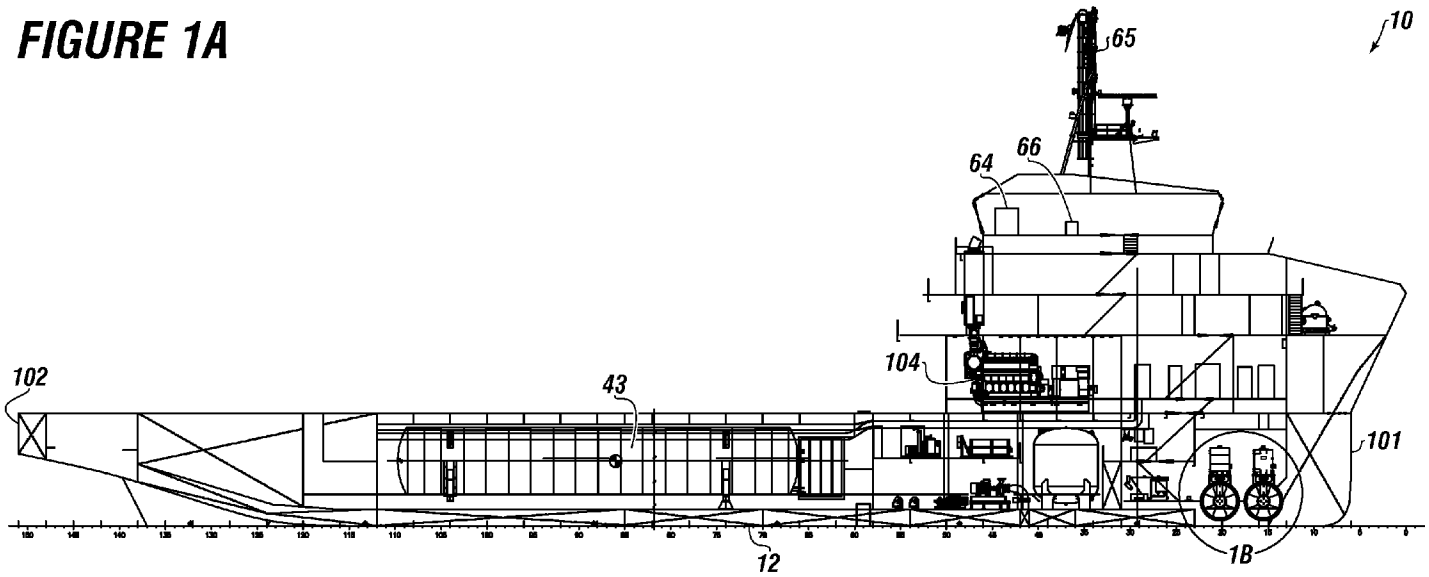
FIG. 1A depicts an inboard profile of the floating vessel according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments generally relate to a floating vessel with improved bow and/or stern thrusters, and a dual fuel version of the floating vessel with an improved gas line trap.

The embodiments, further relate to a floating vessel configured to move through the water at a speed of up to 15 knots.

The floating vessel can be an ocean going barge with thrusters, an oceanographic research vessel, a dredge, a tanker, a cruise ship, a yacht, a ferry, or any floating vessel applicable to the embodiments.

In embodiments, the floating vessel can be a platform supply vessel having a length of 302 feet.

The floating vessel can have a hull. The hull can be a monohull, a catamaran hull, a trimaran hull, a plurality of pontoons connected together, or a circular hull.

At least one thruster tube can be formed in the hull.

A water moving device and power supply can be installed in each thruster tube.

At least one appendage can be installed on the hull. The at least one appendage can partially surround each thruster tube and can encircle from 30 percent to 40 percent of each thruster tube without closing or restricting the thruster tube opening.

A plurality of supports can be used to secure each appendage to the hull around the thruster tube opening.

A fairing plate can be installed between a tangent of each appendage and the hull following a circumference of each thruster tube which can additionally encircle from 30 percent to 40 percent of each thruster tube.

Each fairing plate can be configured to transition water flow from the hull over one of the appendages and into the at least one thruster tube to reduce water turbulent flow across an opening of each thruster tube as water is moved by each water moving device creating a 2 percent improvement in thrust capacity.

A benefit of the appendage is that more thrust can be achieved from the water moving device imparted to the hull using the appendage.

A benefit of the appendage is that less vibration can be generated from water moved by the water moving device when the appendage is mounted around the opening to the thruster tubes on the outside of the hull.

A benefit of the appendage is that thruster vibration can be reduced from 70 percent to 90 percent when the thruster is running from 500 rpm to 700 rpm.

A benefit of the appendage is that thruster vibration can be reduced from 20 percent to 60 percent when the thruster is running from 800 rpm to 890 rpm.

A benefit of the appendage is that greater reductions in vibrations occur when the thruster tubes are shorter.

A benefit of the appendage is that reduction in cavitation of the water moving device increases as the thruster tubes are shortened.

Turning now to the Figures, FIG. 1A is an inboard profile of the floating vessel according to one or more embodiments.

A floating vessel 10 can be configured to move through the water at a speed of up to 15 knots can have a hull 12, a bow 101 and a stern 102.

In embodiments, the hull shape can be round, without bow or stern, or in the form of a plurality of columns connected together with supports.

The floating vessel 10 can be depicted as a dual fuel vessel with a dual fuel propulsion system 104. In embodiments, the floating vessel can have a liquefied natural gas storage tank 43.

The floating vessel 10 can include a dynamic positioning controller 64, which can be connected to both a global positioning system network 65 and a plurality of gyroscopes 66 mounted in the hull.

Figure 1B:
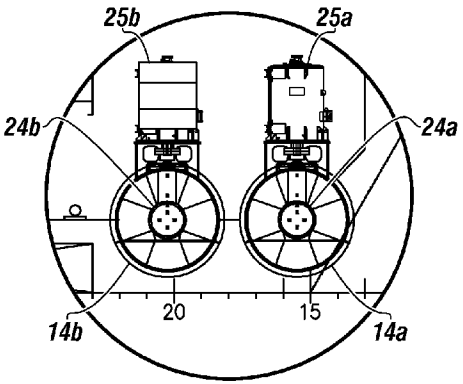
FIG. 1B depicts a detailed side view of a pair of thrusters of FIG. 1A.

In embodiments, the dynamic positioning controller 64 can communicate with at least one water moving device, which is described in detail in FIG. 1B, enabling dynamic positioning of the floating vessel 10 using each water moving device continuously to maintain station while simultaneously reducing fatigue and increasing comfort for onboard crew during operation of each water moving device.

FIG. 1B depicts a detailed side view of a pair of thrusters of FIG. 1A.

A first thruster tube 14*a* and a second thruster tube 14*b* can be mounted near the bow of the floating vessel. At least one thruster tube can be formed in the hull 12.

The embodiments, the invention can be used on thrusters which can be mounted in the thruster tubes that are either proximate to the bow or proximate to the stern of the floating vessel.

Thrusters tubes 14*a* and 14*b* can be mounted almost anywhere on the floating vessel, even near a midpoint, if the thrusters are used for docking a large floating vessel without a tug. The embodiments can be usable on all thrusters formed in the hull of the floating vessel, such as from a 30 foot to 1,000 foot vessel.

In embodiments, the invention can be used on the cowling of portable thruster tubes, such as those which can be removably mounted to barges without intrinsic power of their own.

Each thruster tube 14*a* and 14*b* can have an opening.

A first water moving device 24*a* can be disposed in the first thruster tube 14*a* and a second water moving device 24*b* can be disposed in the second thruster tube 14*b*.

A first power supply 25*a* can supply power to the first water moving device 24*a*. In embodiments, the first power supply 25*a* can be mounted in the first thruster tube 14*a*.

A second power supply 25*b* can supply power to the second water moving device 24*b*. In embodiments, the second power supply 25*b* can be mounted in the second thruster tube 14*b*.

The "water moving devices" as used herein can be non-moving propeller thrusters, but small jets, and small rotatable pods with propellers can be used as well as the water moving devices.

Figure 2:
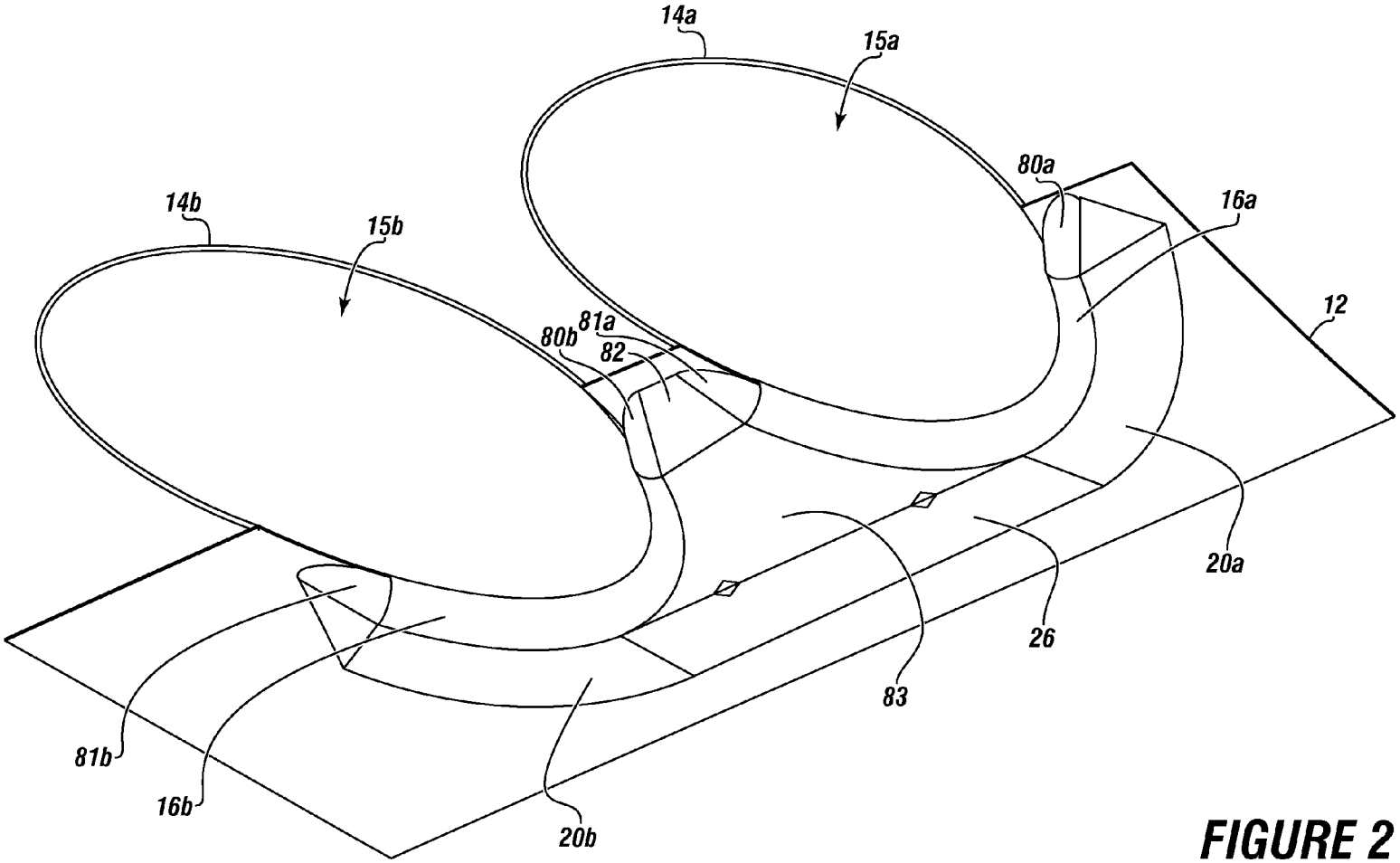
FIG. 2 depicts a detailed perspective view of a pair of thruster tubes through the hull of a floating vessel according to one or more embodiments.

FIG. 2 depicts a detailed perspective view of a pair of thruster tubes through the hull of a floating vessel according to one or more embodiments.

The first thruster tube 14*a* can have a first opening 15*a* and the second thruster tube 14*b* can have second opening 15*b*.

The first and second openings 15*a* and 15*b* can range from 6 inches to several feet in diameter. Each thruster tube 14*a* and 14*b* can have a diameter from 0.3 meters to 5 meters.

In embodiments, the thruster openings can be in a shape of an ellipse at a water/hull interface.

A first appendage 16*a* can partially surround the first thruster tube 14*a*, which can encircle the first thruster tube from 30 percent to 40 percent of the first thruster tube 14*a*.

A second appendage 16*b* can partially surround the second thruster tube 14*b*, which can encircle the second thruster tube from 30 percent and 40 percent of the second thruster tube 14*b*.

In embodiments, each appendage 16*a* and 16*b* can be a half-pipe.

In further embodiments, the half-pipe can be a 12 inch long pipe for thrusters that have a diameter of 36 inches.

In embodiments, if at least two thruster tubes 14*a* and 14*b* are present on a side of the floating vessel, the appendage can be mounted around the thruster tube on the same lower portion, in an orientation that is closest to the keel.

In embodiments, both appendages 16*a* and 16*b* can have the same identical length. In embodiments, when the first thruster tube 14*a* is slightly larger than the second thruster tube 14*b*, the two appendages 16*a* and 16*b* can have slightly different lengths, but the thruster tube opening can be larger.

The first thruster tube 14*a* can have a first bow tapered plate 80*a* and a first stern tapered plate 81*a* connected to the first appendage 16*a*, which is shown as a half-pipe.

The second thruster tube 14*b* can have a second bow tapered plate 80*b* and a second stern tapered plate 81*b* connected to the second appendage 16*b*, which is also shown as a half-pipe.

Each appendage can have a bow tapered plate 80*a* and 80*b* and a stern tapered plate connected on opposite ends of the at least one appendage 16*a* and 16*b*.

In embodiments, the pipe of the half-pipe can be 1 inch diameter stock at the intersection of the tapered end plates and each appendage.

A knuckle plate 83 can be secured between the first appendage 16*a* and the second appendage 16*b* for reducing vibration as well as a tapered mid plate 82 connecting the first stern tapered plate 81*a* and the second bow tapered plate 80*b*.

In embodiments, thee knuckle plate 83 can be a ½ of an inch plate in thickness and fill the space between the two appendages 16*a* and 16*b* on at least one thruster tube.

In embodiments, a knuckle plate is not needed for a single thruster tube with a single appendage.

A first fairing plate 20*a* can be installed so that the first fairing plate 20*a* can have an edge that follows a circumference of the first thruster tube 14*a*. Like the first appendage 16*a*, the first fairing plate 20*a* can encircle the first thruster tube from 30 percent to 40 percent.

The first fairing plate 20*a* can be configured to transition water flow from the hull 12 over the appendage 16*a* and into the first thruster tube 14*a* to reduce water turbulent flow across the thruster tube opening as water can be moved by that thruster tube's water moving device creating at least a 2 percent improvement in thrust capacity of the water moving device than the water moving device otherwise provides without the appendage.

A second fairing plate 20*b* can be installed so that the second fairing plate 20*b* can have an edge that follows the same portion of the circumference of the second thruster tube 14*b*. Like the second appendage 16*b*, the second fairing plate 20*b* can encircle the second thruster tube from 30 percent to 40 percent.

A fairing transition plate 26 can connect the first fairing plate 20*a* and the second fairing plate 20*b*. In embodiments, the fairing transition plate 26 can have a thickness of 1.5 inches.

In embodiments, the fairing plates can have a ⅜ inch thickness.

In embodiments, the fairing transition plate can be ½ inch thick.

Figure 3:
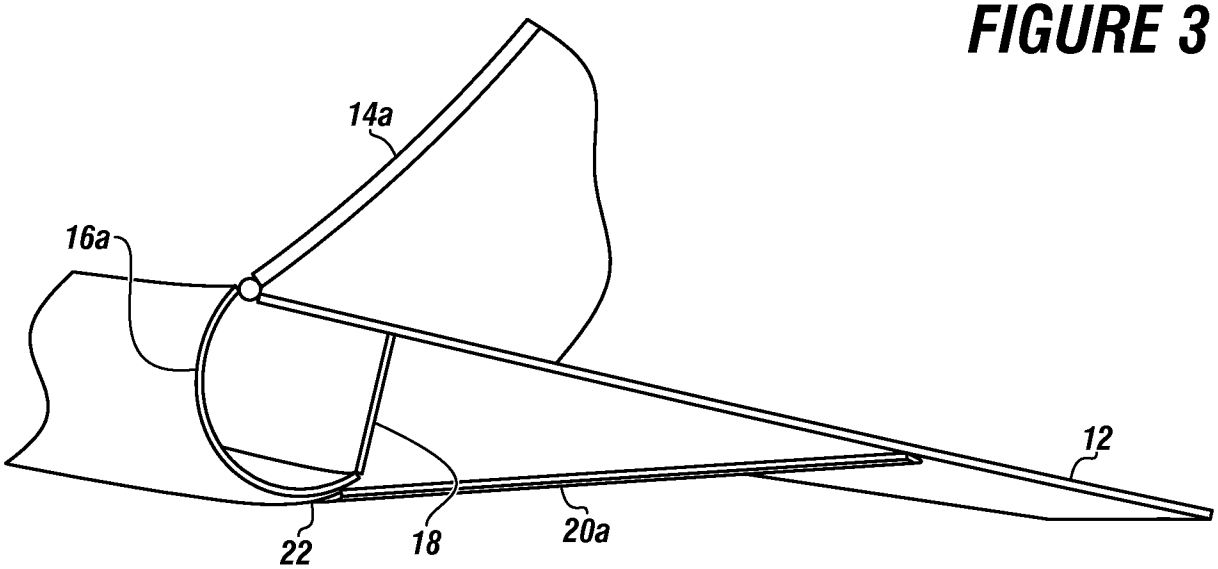
FIG. 3 depicts a sectional view through an appendage according to one or more embodiments.

FIG. 3 depicts a sectional view through an appendage according to one or more embodiments.

The first fairing plate 20*a* can be attached to the hull 12 with at least one support 18 attached at a tangent 22 to the first appendage 16*a*.

The at least one support 18 can be used to secure the appendage to the hull of the floating vessel.

In embodiments, the at least one support 18 can be 10 inches high and 19 inches long and solid plate steel. In embodiments, a plurality of supports can be used.

FIG. 4 depicts an elevation view of the second appendage presented as a half-pipe according to one or more embodiments.

The second appendage 16*b* is presented as a half-pipe, wherein the half-pipe can be formed from a group of segments 36*a*, 36*b*, and 36*c* joined to form a one piece integral half-pipe.

In embodiments, the appendages can be made from fiberglass, carbon fiber, steel, stainless steel, or combinations thereof. In further embodiments, the appendages can be coated with a marine fouling coating.

FIG. 5 depicts a side view of a relief gas line vent trap usable in a dual fuel version of the floating vessel of FIG. 1A.

In this dual fuel version of the floating vessel, a relief gas line vent trap 40 can be installed in a main relief line 42 connected to a liquefied natural gas storage tank or a liquefied natural gas bunker station 44, as shown in this Figure.

The relief gas line vent trap 40 can have a gas inlet pipe 50 with an angle of declination 57 from the main relief line 42 to prevent back up of water into the main relief line 42.

The relief gas line vent trap 40 can have a body 52 with a top 53, wherein the body 52 can fluidly connect to the gas inlet pipe 50.

The top 53 can be configured to align with a plane 62, which can be angled from 10 degrees to 40 degrees from a vertical axis of the body that extends through the drain 58.

The body 52 can have a reservoir 54 for receiving fluid from the gas inlet pipe 50.

The body 52 can have a hinged balanced lid 56 secured to the body 52 opposite the reservoir 54 which can close over the top 53.

The hinged balanced lid can be configured to minimize gas escaping from the body 52 and to simultaneously reduce back pressure caused by the gas.

In embodiments, the drain 58 can be fluidly connected to the reservoir 54 to allow fluid from the gas inlet pipe 50 to exit the body 52.

In embodiments, the angle of declination 57 can be from 40 degrees to 50 degrees from a central axis of the main relief line 42 to prevent back up of water into the main relief line 42.

In embodiments, the body 52 and the gas inlet pipe 50 can be made from stainless steel. The body 52 and gas inlet pipe 50 can be configured to enable cryogenic fluids to pass through the gas inlet pipe 50 and body 52 without the gas inlet pipe 50 and body 52 cracking or rupturing.

The relief gas line vent trap 40 can include a stop 60 to prevent the hinged balanced lid 56 from opening more than 90 degrees from the plane 62 of the top 53.

A screen 63 can also be secured in the body 52 to prevent particulate from flying out of the body 52.

While these embodiments have been described with emphasis on the embodiments, it should be understood that within the scope of the appended claims, the embodiments might be practiced other than as specifically described herein.

What is claimed is:

1. A floating vessel configured to move through water at a speed of up to 15 knots, the floating vessel comprising:

a. a hull;

b. at least one thruster tube formed in the hull, wherein the at least one thruster tube has an opening;

c. at least one water moving device disposed in the at least one thruster tube;

d. at least one power supply connected to the at least one water moving device;

e. at least one appendage partially surrounding the at least one thruster tube and encircling the at least one thruster tube from 30 percent to 40 percent of the at least one thruster tube;

f. a plurality of supports securing the at least one appendage to the hull; and g. at least one fairing plate installed between a tangent of the at least one appendage and the hull, the at least one fairing plate installed following a circumference of the at least one thruster tube and encircling the at least one thruster tube from 30 percent to 40 percent of the at least one thruster tube, the at least one fairing plate configured to transition water flow from the hull over the at least one appendage and into the at least one thruster tube to reduce water turbulent flow across the opening of the at least one thruster tube as water is moved by the at least one water moving device creating at least a 2 percent improvement in thrust capacity of the at least one water moving device than without the at least one appendage.

2. The floating vessel of claim 1, wherein the at least one thruster tube is mounted proximate to a bow or a stern.

3. The floating vessel of claim 1, further comprising a fairing transition plate for connecting a first fairing plate around a first thruster tube to a second fairing plate around a second thruster tube.

4. The floating vessel of claim 1, wherein the at least one appendage is a half-pipe.

5. The floating vessel of claim 4, wherein the half-pipe comprises at least one of: fiberglass, carbon fiber, steel, and stainless steel.

6. The floating vessel of claim 1, wherein the opening of the at least one thruster tube is in a shape of an ellipse at a water/hull interface.

7. The floating vessel of claim 1, wherein the at least one thruster tube has a diameter from 0.3 meters to 5 meters.

8. The floating vessel of claim 4, wherein the half-pipe comprises a plurality of segments joined to form a one piece integral half-pipe.

9. The floating vessel of claim 1, further comprising a dual fuel propulsion system, wherein the dual fuel propulsion system is automatically switchable between natural gas and diesel fuel.

10. The floating vessel of claim 9, comprising a relief gas line vent trap installed in a main relief line connected to a liquefied natural gas storage tank or a liquefied natural gas bunker station, the relief gas line vent trap comprising:

a. a gas inlet pipe with an angle of declination from the main relief line to prevent back up of water into the main relief line; and b. a body with a top, wherein the body is fluidly connected to the gas inlet pipe, the body comprising:

(i) a reservoir for receiving fluid from the gas inlet pipe;

(ii) a hinged balanced lid secured to the body opposite the reservoir with the hinged balanced lid configured to minimize gas escaping from the body and to simultaneously reduce back pressure caused by gas; and (iii) a drain fluidly connected to the reservoir to allow fluid from the gas inlet pipe to exit the body.

11. The floating vessel of claim 10, wherein the angle of declination is from 40 degrees to 50 degrees from a central axis of the main relief line to prevent back up of water into the main relief line.

12. The floating vessel of claim 10, wherein the body and the gas inlet pipe comprise stainless steel and are configured to enable cryogenic fluids to pass through the body and the gas inlet pipe without the body or the gas inlet pipe cracking or rupturing.

13. The floating vessel of claim 10, comprising a stop to prevent the hinged balanced lid from opening more than 90 degrees from a plane of the top.

14. The floating vessel of claim 13, further comprising a screen secured in the body.

15. The floating vessel of claim 1, comprising a dynamic positioning controller connected to a global positioning system network and a plurality of gyroscopes mounted in the hull, wherein the dynamic positioning controller is in communication with the at least one water moving device enabling dynamic positioning of the floating vessel using the at least one water moving device continuously to maintain station while simultaneously reducing fatigue and increasing comfort for onboard crew during operation of each water moving device.

16. The floating vessel of claim 1, further comprising a bow tapered plate and a stern tapered plate connected on opposite ends of the at least one appendage.

17. The floating vessel of claim 16, comprising a knuckle plate secured between a first appendage and a second appendage for reducing vibration.

* * * * *